US006648113B1

(12) United States Patent
Bellfy

(10) Patent No.: US 6,648,113 B1
(45) Date of Patent: Nov. 18, 2003

(54) CLUTCH PEDAL LOCKING ASSEMBLY

(75) Inventor: Paul Bellfy, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/063,001

(22) Filed: Mar. 11, 2002

(51) Int. Cl.[7] ..... G05G 5/24
(52) U.S. Cl. ..... 192/3.63; 74/529; 192/114 R
(58) Field of Search ..... 192/3.61, 3.62, 192/3.63, 114 R; 74/529

(56) References Cited

U.S. PATENT DOCUMENTS

| | | | | | |
|---|---|---|---|---|---|
| 1,565,421 | A | * | 12/1925 | Craig | 192/114 R |
| 1,927,209 | A | * | 9/1933 | Gilmore | 74/529 |
| 2,028,198 | A | * | 1/1936 | Elliot | 192/114 R |
| 2,051,975 | A | * | 8/1936 | Wemp | 192/114 R |
| 2,194,040 | A | * | 3/1940 | Wemp | 192/114 R |
| 3,092,229 | A | * | 6/1963 | Uher | 192/114 R |
| 3,741,356 | A | * | 6/1973 | Sieren et al. | 192/3.61 |
| 4,057,135 | A | | 11/1977 | Mori | |
| 4,319,497 | A | | 3/1982 | Shinto et al. | |
| 4,522,082 | A | | 6/1985 | Musumiya et al. | |
| 4,624,152 | A | | 11/1986 | Stotz et al. | |
| 4,684,769 | A | | 8/1987 | Beck et al. | |
| 5,048,656 | A | * | 9/1991 | Braun | 192/114 R |
| 5,056,632 | A | * | 10/1991 | Lemp et al. | 192/3.63 |
| 5,148,899 | A | * | 9/1992 | Berger | 192/3.63 |
| 6,089,055 | A | | 7/2000 | Vito | |

FOREIGN PATENT DOCUMENTS

| | | | |
|---|---|---|---|
| EP | 0 691 235 | | 1/1996 |
| JP | 4-259018 A | * | 9/1992 |
| JP | 9-136558 A | * | 5/1997 |

OTHER PUBLICATIONS

Abstract for JP 4–259018 Sep. 1992.
Abstract for JP 9–136558 May 1997.

* cited by examiner

*Primary Examiner*—Rodney H. Bonck

(57) ABSTRACT

A clutch pedal locking assembly for a vehicle having a manual transmission and a clutch. A latch assembly, when actuated, holds a clutch pedal down after the vehicle operator presses the clutch pedal down, thus leaving the vehicle clutch disengaged even when the operator removes his foot from the clutch pedal. When the latch assembly is deactivated, the clutch pedal will operate the same as a conventional clutch pedal in a manual transmission vehicle. The latch assembly may be activated and deactivated by a cable that connects to an activation collar on the gear shift lever.

7 Claims, 6 Drawing Sheets

CLUTCH PEDAL LOCKING ASSEMBLY

BACKGROUND OF INVENTION

The present invention relates to vehicles employing clutch pedals to engage and disengage a clutch, and more particularly to mechanisms for assisting a driver in operating the clutch pedal.

Conventional manual transmission vehicles have a clutch which disengages the transmission from the engine, which is used while shifting gears and when the vehicle is standing still while in gear. While a manual transmission is desirable over an automatic transmission for some, due to the better fuel economy and the lower cost, the automatic transmission still has the convenience of allowing one to stop at a traffic light without having to hold down a clutch pedal while stopped and in gear.

Many vehicle operators prefer to keep a vehicle in gear when stopped at a traffic light or stopped in heavy traffic in anticipation of starting the vehicle moving forward. However, when a vehicle is stopped in traffic or at a traffic light, the operator must hold down the clutch the entire time if he wishes to keep the vehicle in gear while stopped. If there are many traffic lights or the operator is in a traffic jam, then the leg which holds in the clutch pedal can become fatigued.

Thus, it is desirable to have a clutch pedal assembly where one may wait in a traffic jam or at a stop light with a manual transmission in gear, but without the need to constantly apply foot pressure to the clutch pedal while waiting to begin moving again.

SUMMARY OF INVENTION

In its embodiments, the present invention contemplates a clutch pedal locking assembly for use with a clutch pedal in a vehicle, with the clutch pedal actuable by a vehicle operator between a clutch engagement position and a clutch disengagement position. The clutch pedal locking assembly includes a latch assembly mounted to the vehicle adjacent to the clutch pedal, selectively securable to the clutch pedal when the clutch pedal is in the clutch disengagement position, and an activation apparatus switchable between an activation position and a deactivation position. The clutch pedal locking assembly also includes a transmitting apparatus connected between the latch assembly and the activation apparatus, with the transmitting apparatus causing the latch assembly to be not secured to the clutch pedal when the activation apparatus is in the deactivation position, and the transmitting apparatus causing the latch assembly to be secured to the clutch pedal when the activation apparatus is in the activation position and the clutch pedal is in the disengagement position, whereby the clutch pedal will remain in the disengagement position until the activation apparatus is switched to the deactivation position.

The present invention further contemplates a method of selectively securing a clutch pedal in a vehicle that is driven by a vehicle operator, with the clutch pedal movable by the vehicle operator between a clutch engagement position and a clutch disengagement position, the method comprising the steps of: actuating a switch apparatus from a deactivation state to an activation state; communicating the activation state to a latch assembly; moving the clutch pedal to the clutch disengagement position; and securing the latch assembly to the clutch pedal to maintain the clutch in the disengagement position until the actuating switch apparatus is moved from the activation state to the deactivation state.

An embodiment of the present invention allows a vehicle operator to engage a lock device that will hold a clutch pedal in its disengaged position once the vehicle operator depresses the clutch pedal from its engaged position.

An advantage of the present invention is that a vehicle operator can actuate the locking device and depress the clutch pedal to its disengaged position, while waiting at a traffic light or in heavy traffic, and remove his foot from the clutch pedal without the clutch pedal engaging the vehicle's clutch. In this way, the vehicle operator may rest his leg while waiting to begin moving again without having to take the transmission out of gear.

Another advantage of the present invention is that it is a low cost alternative to an automatic transmission that provides the advantage of not having to hold ones foot on the clutch while stopped in traffic or at a traffic light.

DETAILED DESCRIPTION

Figure 1:
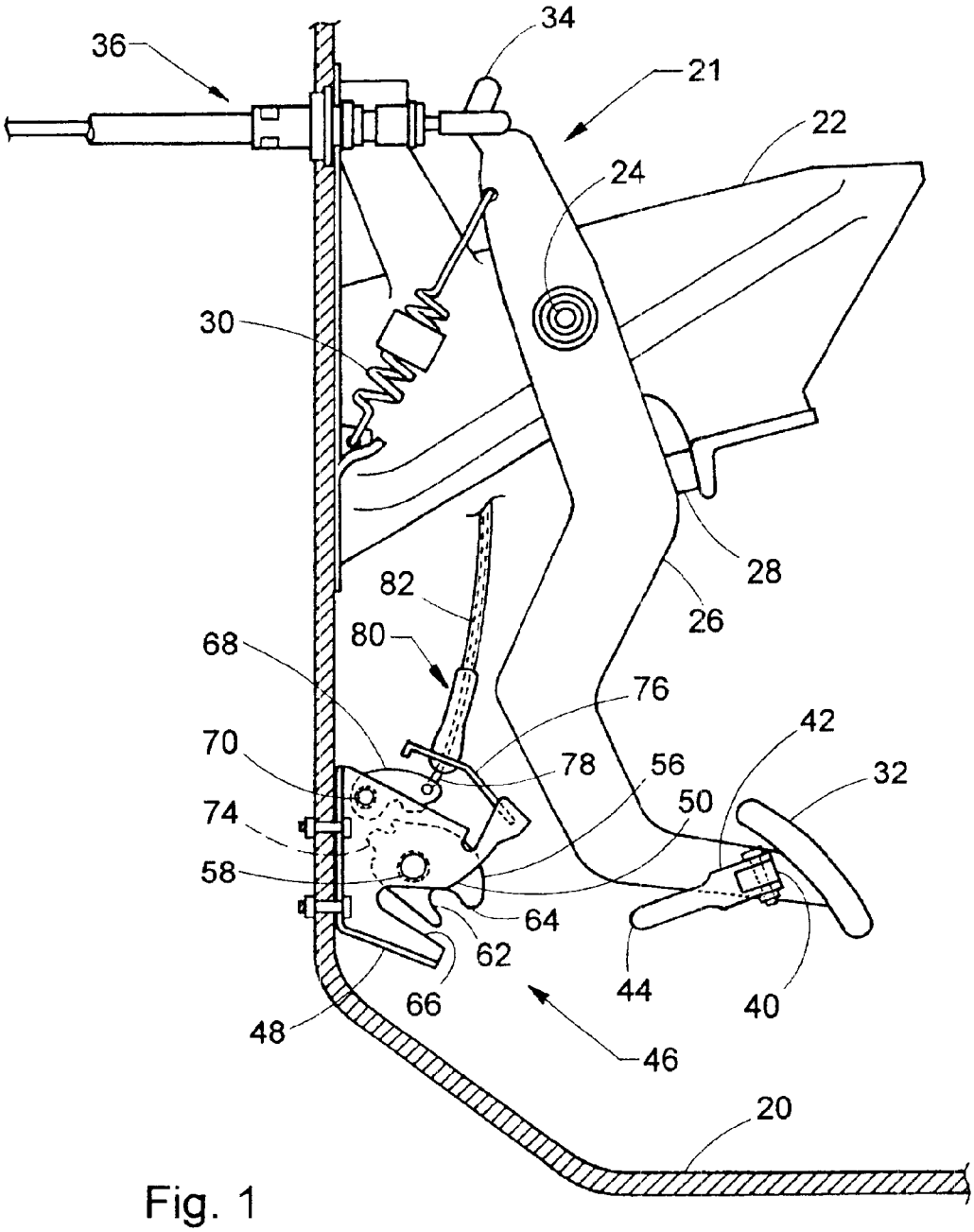
FIG. 1 is a side, elevation view of a vehicle clutch pedal and clutch pedal locking assembly in accordance with the present invention.
Figure 2:
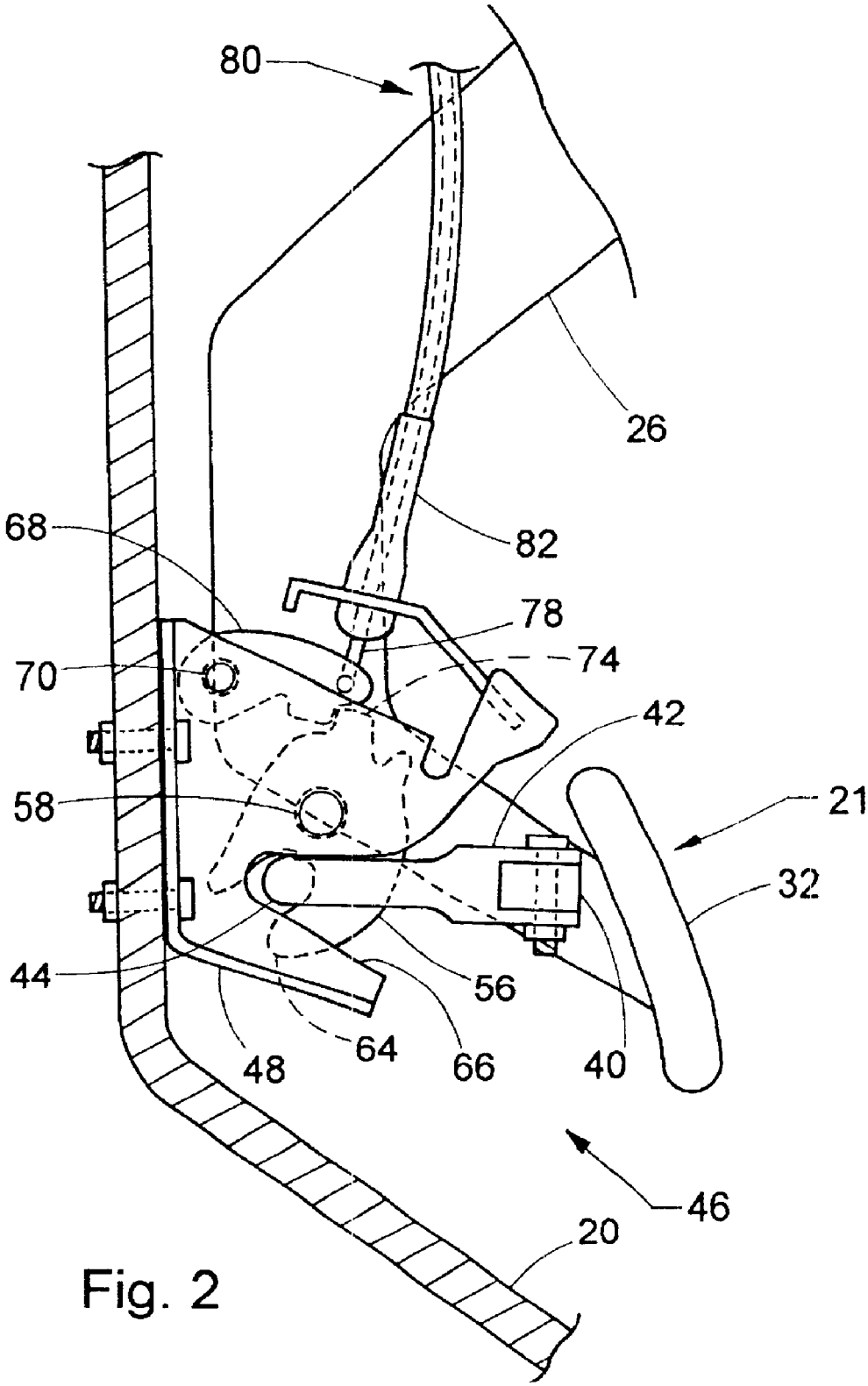
FIG. 2 is a view similar to FIG. 1, but with the clutch pedal shown depressed and the clutch pedal locking assembly in the engaged position.
Figure 3:
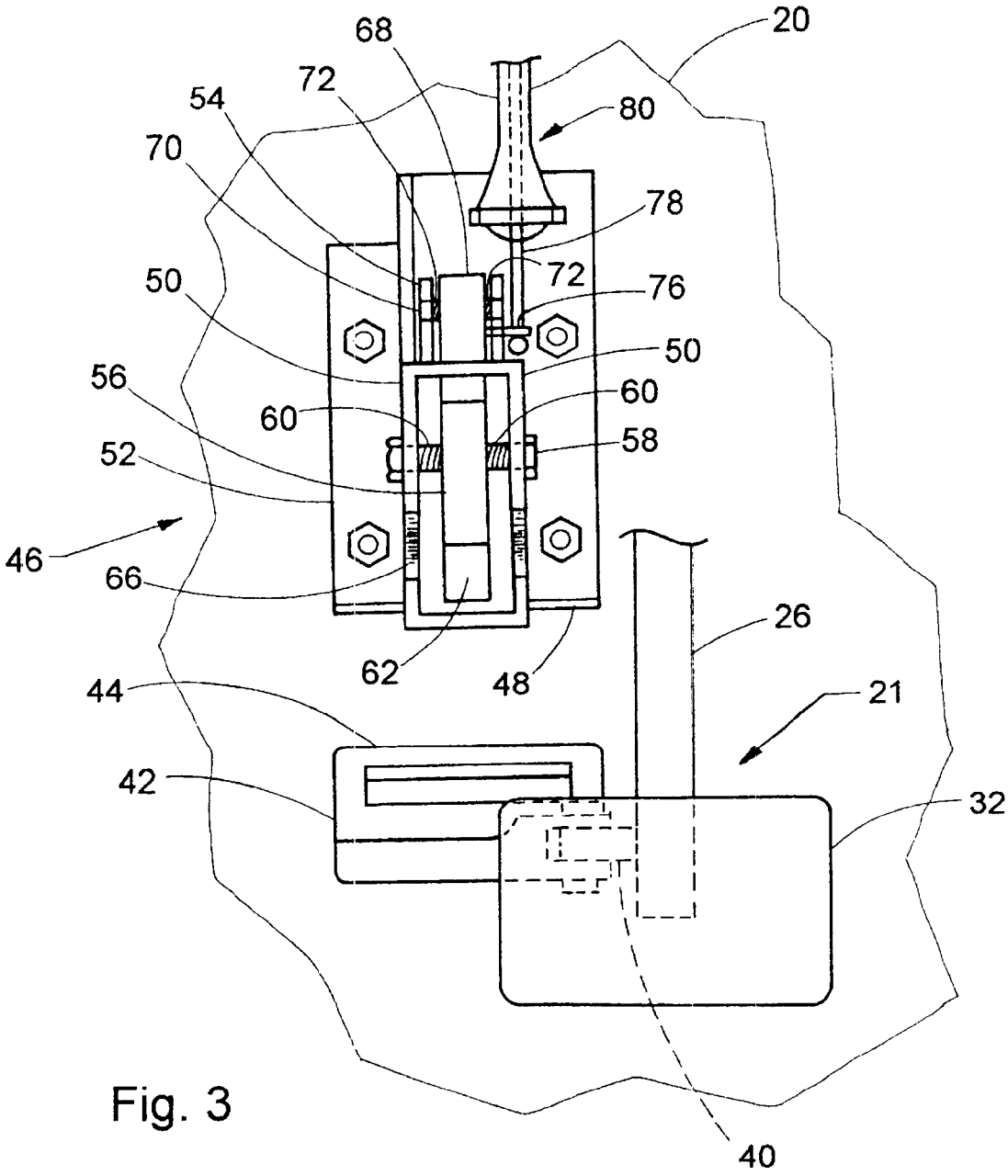
FIG. 3 is a is a front, elevation view of the clutch pedal and clutch pedal locking assembly of FIG. 1.

FIGS. 1–3 illustrates a vehicle floor pan 20, with a clutch pedal assembly 21 mounted thereto. The clutch pedal assembly 21 includes a support bracket 22. The clutch pedal support bracket 22 includes a pivot lug 24, for pivotally supporting a clutch pedal arm 26, and a clutch rebound bumper 28, for limiting the travel of the clutch pedal arm 26 away from the floor pan 20. A return spring 30 mounts between the clutch pedal support bracket 22 and the clutch pedal arm 26 to bias the clutch pedal arm 26 against the clutch rebound bumper 28. The clutch pedal arm 26 supports a clutch foot pad 32, for receiving the foot of a vehicle operator, and a finger 34 for engaging a clutch actuation cable assembly 36. The clutch actuation cable assembly 36 extends to the vehicle clutch (not shown).

All of the components of the clutch pedal assembly 21 discussed so far are conventional in design and operation and may vary somewhat from vehicle to vehicle, so they are merely one example of a clutch assembly with which a clutch pedal locking assembly may be used. For example, the bracket and return mechanism may be configured differently to allow for a conventional pedal height self adjusting mechanism, or a conventional clutch actuation rod or hydraulic system may be employed instead of the clutch actuation cable.

The clutch pedal assembly 21 also includes striker mount lug 40 welded to or cast integrally with the clutch pedal arm 26. A striker 42 is bolted to the mount lug 40, and includes a striker finger portion 44. While conventional clutch pedal arms are made of metal, the clutch pedal arm 26 can also be made of a plastic material, with the lug 40 and/or the striker 42 molded integral with the clutch pedal arm itself.

A latch assembly 46 is bolted to the floor pan 20, behind and just off center from the clutch pedal arm 26. The latch assembly 46 includes a support frame 48, which includes a pair of ratchet support arms 50 extending from a base portion 52 and a pair of pawl support arms 54 also extending from the base portion 52. The ratchet support arms 50 support and allow for rotational movement of a ratchet 56 via a pivot pin 58. A pair of springs 60 are engaged between the ratchet support arms 50 and the ratchet 56 in order to bias the ratchet 56 into its open position. The ratchet 56 includes an engagement slot 62 formed by a pair of catch fingers 64 which, when aligned with a pair of slots 66 in the ratchet support arms 50 allows the engagement slot 62 to receive the striker finger portion 44 of the striker 42. The latch assembly's open position is illustrated in FIGS. 1 and 3.

A pawl 68 is supported and allowed to rotate relative to the pawl support arms 54 via a pivot pin 70. A pair of springs 72 are engaged between the pawl support arms 54 and the pawl 68 in order to bias the pawl into engagement with a catch 74 on the ratchet 56, (rotationally clockwise as viewed in FIGS. 1 and 2). The pawl 68 includes a cable attachment tab 76, which receives one end of an actuation cable 78 from an actuation cable assembly 80. The actuation cable assembly 80 includes a cable sleeve 82, which encloses the cable 78, and is mounted on one end to the support frame 48.

Figure 4:
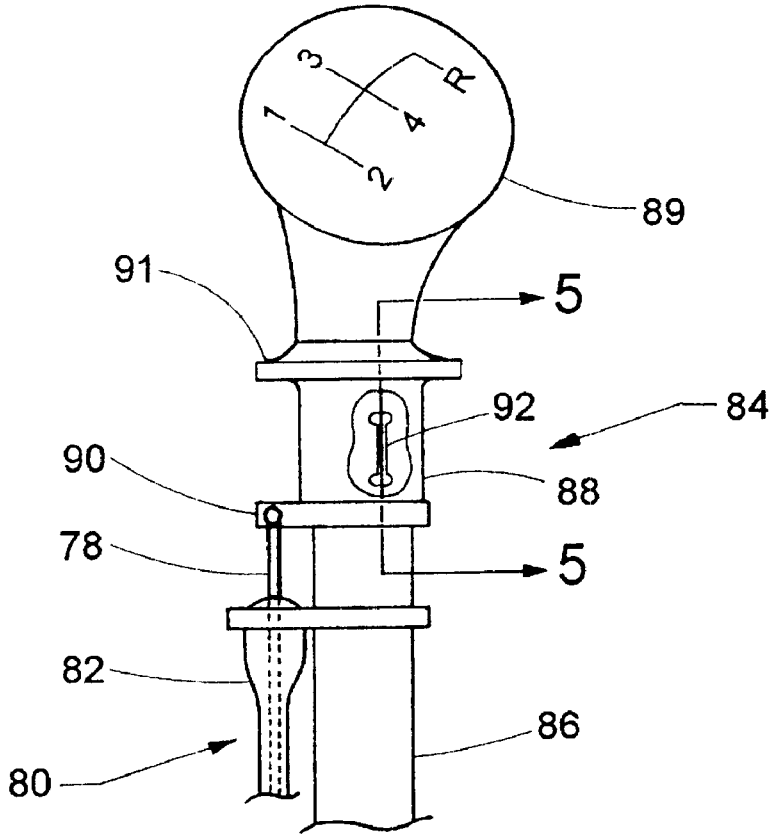
FIG. 4 is a side elevation view of a vehicle gear shift lever assembly in accordance with the present invention.
Figure 5:
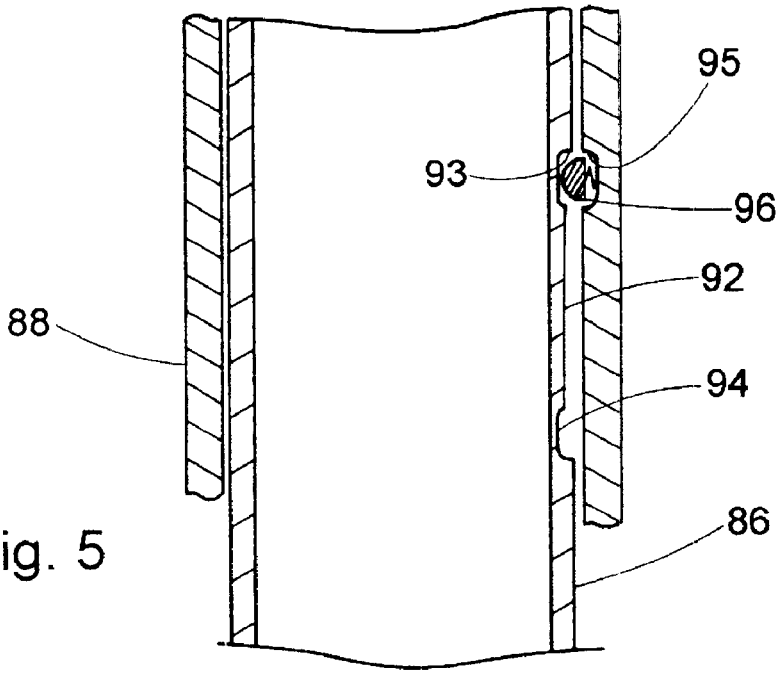
FIG. 5 is a sectional view taken along line 5—5 in FIG. 4.

22 The actuation cable assembly 80 extends from the latch assembly 46 to a gear shift lever assembly 84, illustrated in FIGS. 4 and 5. The cable sleeve 82 is mounted on its other end to a shift rod 86 of the gear shift lever assembly 84. The gear shift lever assembly 84 also includes an activation collar 88 mounted around and slidable on the shift rod 86, just below a gear shift knob 89. The collar 88 includes a cable attachment tab 90, which receives the other end of the actuation cable 78. The collar is shaped to form a finger pull 91 at the top of the collar 88, within easy reach of the fingers of a vehicle operator who has his hand on the gear shift knob 89.

The shift rod 86 includes a guide recess 92 in its outer surface, with the guide recess 92 including a deactivation detent 93 and an activation detent 94. A recess 95 on the inside surface of the collar 88 retains a ball and spring assembly 96, with the ball and spring assembly 96 engaged within the guide recess 92. In this way, the guide recess 92 guides and limits the travel of the collar 88, with the collar 88 biased into a full up or full down position. Since the springs 72 cause the cable 78 to be pulled down (as seen in FIGS. 1 and 2), there will be tension in the cable 78 when the collar 88 is in the up position (release latching). When the collar 88 is moved down (latched position) in order to enable latching, this will release the tension in the cable 78.

The operation of the clutch pedal lock assembly will now be described in relation to FIGS. 1–5. When a vehicle operator is driving the vehicle, the clutch pedal assembly 21 will be in its up (clutch engaged) position, and the latch assembly 46 will be in its open position, (as is illustrated in FIG. 2). As a vehicle operator is driving down a road and sees a red traffic light ahead, he may begin braking and then depress the clutch pedal foot pad 32 to disengage the vehicle's clutch. Since clutch pad 32 is pushed all of the way down, the striker finger 44 will be contained within the engagement slot 62, with the catch fingers 64 of the ratchet 56 caused to rotate downward.

If the collar 88 is in the up position, (with the ball and spring 96 in the deactivation detent 93), then the actuation cable 78 will hold the pawl 68 away from the ratchet 56. So when the operator moves his foot to allow the clutch pad 32 to raise up, the striker 42 will merely pull out of the ratchet 56 causing the ratchet 56 to be rotated back to its open position, where the springs 60 will hold it. The clutch pad 32 will raise up to its clutch engaged position, just the same as with a conventional manual transmission vehicle. The same also happens when shifting between gears as the vehicle operator accelerates up to speed. Thus,.when the collar 88 is in its up position, the latch assembly 46 will have no effect on vehicle operation.

If, on the other hand, the operator wishes to remove his foot from the clutch pad 32 while waiting at a traffic light, (or as a result of other traffic conditions), then he will push the collar 88 on the gear shift rod 86 down to the latch activation position, (with the ball and spring 96 in the activation detent 94). Since clutch pad 32 is pushed all of the way down, the striker finger 44 will again be contained within the engagement slot 62, with the catch fingers 64 of the ratchet 56 caused to rotate downward. This time, however, the actuation cable 78 and springs 72 will cause the pawl 68 to rotate into contact with the ratchet 56. The ratchet 56, then, cannot rotate into its open position. If the operator moves his foot to allow the clutch pad 32 to raise up, the striker 42 will not move because the striker finger portion 44 will remain trapped in the engagement slot 62 of the ratchet 56. Consequently, the clutch will remain in its down position, and the vehicle's clutch will remain disengaged.

The vehicle operator, then, can leave the vehicle's transmission (not shown) in gear without having to hold down the clutch the entire time. When the operator wishes to begin moving again, he places his foot on the clutch pad 32, then pulls up on the engagement collar 88 to disengage the clutch latch assembly 46. Operation is again just as with conventional manual transmission shifters. If, on the other hand, the operator pulls up on the collar 88 to release the clutch latch assembly 46 without placing his foot on the clutch pad 32 first, the clutch will spring out quickly, and since there is no vehicle movement and generally not much throttle opening, the vehicle engine will stall, with minimum forward movement of the vehicle.

Figure 6:
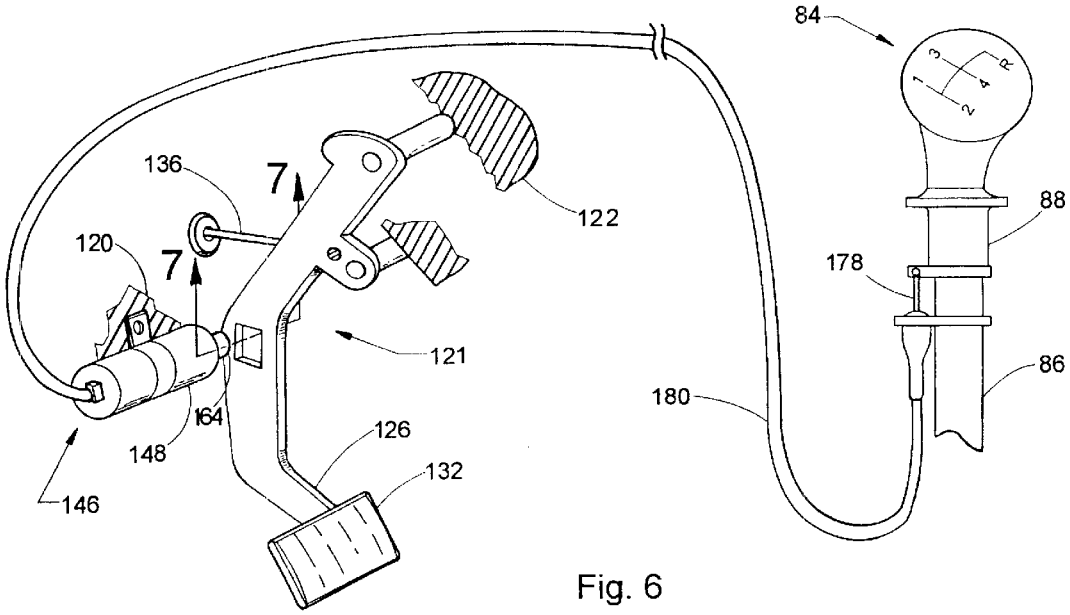
FIG. 6 is a perspective view of an alternate embodiment of the present invention.
Figure 7:
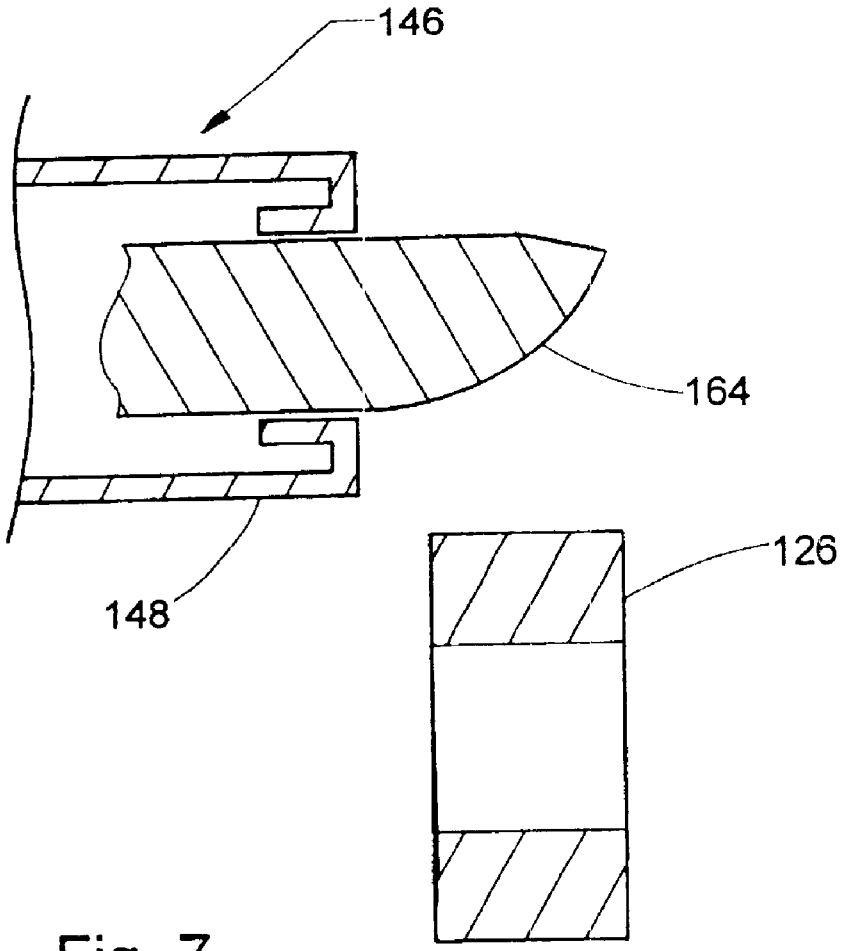
FIG. 7 is a sectional view taken along line 7—7 in FIG. 6.

FIGS. 6 and 7 illustrate an alternate embodiment of the clutch pedal locking assembly. For purposes of this description, elements in this embodiment that have counterpart elements in the first embodiment have been identified by similar reference numerals, although they are 100 series numbers. The gear shift assembly 84, shift rod 86 and actuation collar 88 are the same as in the first embodiment, but the actuation cable assembly 180 extends to a different latch assembly 146. The clutch pedal assembly 121 is somewhat different, in that the clutch pedal arm 126 is shaped to mount to a different clutch support bracket 122 and a push rod 136 is employed rather than the clutch actuation cable. But this clutch assembly is also a common type of clutch assembly used in manual transmission vehicles.

The latch assembly 146 for holding down the clutch pedal arm 126 is significantly changed from the first embodiment. The latch assembly 146 includes a support frame 148 that is mounted to the floor pan 120. The cable assembly 180 connects to the support frame 148 and the actuation cable 178 is coupled to the catch finger 164. The catch finger 164 is located close to the path of the clutch pedal arm 126 and can move telescopically relative to the support frame 148.

The operation is similar to the first embodiment, in that, when the collar 88 is in its upward (deactivated) position, the clutch pedal assembly 121 and gear shift assembly 84 will operate the same as with a conventional manual transmission vehicle. If, on the other hand, the collar 88 is moved down, into its activated position, while the clutch pad 32 is pressed down, the catch finger 164 will slide out and catch the clutch pedal arm 126 when the operator takes his foot off of the clutch foot pad 132. The clutch pedal will then stay down (and the vehicle clutch disengaged) until the operator pulls the collar 88 back up to its deactivated position. If so desired, a spring or other compliant member can be located between the clutch actuation cable 178 and the catch finger 164 in order to allow the finger 164 to slide in temporarily as the clutch pedal arm 126 passes, if the latch assembly 146 is actuated prior to the operator of the vehicle depressing the clutch pad 132.

Other variations of the clutch pedal lock are also possible. For example, one can locate the engagement switch on the steering column or the instrument panel rather than on the gear shift rod, if so desired. Also, rather than an actuation cable connecting the engagement switch to the pedal lock assembly, one can employ an electromechanical device, such as a solenoid, to engage and disengage a finger or latch that holds the clutch pedal in place. Such a solenoid is preferably an energize-to-extend type (or an energize-to-latch type) and will have a chamfered metal shaft which will line up with a hole in the clutch pedal when it is fully depressed. An additional electronic module, preferably located under the instrument panel, will receive signals, such as vehicle velocity, clutch pedal position, ignition power, ground, and actuating switch signals. The module will then actuate the solenoid when the vehicle velocity is less than 5 miles per hour, the clutch pedal is in, and the ignition is on. In this way, additional features, such as a lockout above a certain vehicle speed (such as 5 miles per hour) can be implemented in the control logic for the solenoid or other electromechanical mechanism employed. Also, if desired, an instrument cluster indicator lamp may be employed, which lights when the clutch locking device is activated. Another example of a variation is to recess the latch assembly into the floor pan and mount the striker on the forward flat of the clutch pedal arm.

While certain embodiments of the present invention have been described in detail, those familiar with the art to which this invention relates will recognize various alternative designs and embodiments for practicing the invention as defined by the following claims.

What is claimed is:

1. A clutch pedal locking assembly for use with a clutch pedal in a vehicle, with the clutch pedal actuable by a vehicle operator between a clutch engagement position and a clutch disengagement position, the clutch pedal locking assembly comprising:

a latch assembly mounted to the vehicle adjacent to the clutch pedal, selectively securable to the clutch pedal when the clutch pedal is in the clutch disengagement position;

an activation apparatus switchable between an activation position and a deactivation position and including a collar mounted on a gear shift rod slidable along the gear shift rod between the activation position and the deactivation position; and a transmitting apparatus including a cable connected between the latch assembly and the collar of the activation apparatus, with the transmitting apparatus causing the latch assembly to be not secured to the clutch pedal when the activation apparatus is in the deactivation position, and the transmitting apparatus causing the latch assembly to be secured to the clutch pedal when the activation apparatus is in the activation position and the clutch pedal is in the disengagement position, whereby the clutch pedal will remain in the disengagement position until the activation apparatus is switched to the deactivation position.

2. The clutch pedal locking assembly of claim 1 wherein the latch assembly includes a ratchet assembly, with the ratchet assembly including a ratchet having a clutch pedal engagement finger and a pawl coupled to the cable, the pawl movable by the cable into and out of engagement with the ratchet; and the clutch pedal includes a striker extending therefrom which is securable to the engagement finger of the ratchet.

3. The clutch pedal locking assembly of claim 1 wherein the latch assembly includes a housing mounted to the vehicle and a latch finger telescopically mounted in the housing and coupled to the cable.

4. A clutch pedal locking assembly for use with a clutch pedal in a vehicle, with the clutch pedal actuable by a vehicle operator between a clutch engagement position and a clutch disengagement position and including a striker, the clutch pedal locking assembly comprising:

a latch assembly mounted to the vehicle adjacent to the clutch pedal, selectively securable to the clutch pedal when the clutch pedal is in the clutch disengagement position, with the latch assembly including a ratchet assembly, and with the ratchet assembly including a ratchet having a clutch pedal engagement finger and a pawl;

an activation apparatus switchable between an activation position and a deactivation position; and a transmitting apparatus connected between the pawl of the latch assembly and the activation apparatus, with the transmitting apparatus causing the pawl to be moved out of engagement with the ratchet in order to be not secured to the clutch pedal when the activation apparatus is in the deactivation position, and the transmitting apparatus causing the pawl to be engaged with the ratchet such that the engagement finger is secured to the striker when the activation apparatus is in the activation position and the clutch pedal is in the disengagement position, whereby the clutch pedal will remain in the disengagement position until the activation apparatus is switched to the deactivation position.

5. A clutch pedal assembly for use in a vehicle that is driven by a vehicle operator, the clutch pedal assembly comprising:

a clutch pedal actuable by the vehicle operator between a clutch engagement position and a clutch disengagement position;

a latch assembly mounted to the vehicle adjacent to the clutch pedal, selectively securable to the clutch pedal when the clutch pedal is in the clutch disengagement position;

an activation apparatus switchable between an activation position and a deactivation position and including a collar mounted on a gear shift rod slidable along the gear shift rod between the activation position and the deactivation position; and a transmitting apparatus including a cable connected between the latch assembly and the collar of the activation apparatus, with the transmitting apparatus causing the latch assembly to be not secured to the clutch pedal when the activation apparatus is in the deactivation position, and the transmitting apparatus causing the latch assembly to be secured to the clutch pedal when the activation apparatus is in the activation position and the clutch pedal is in the disengagement position, whereby the clutch pedal will remain in the disengagement position until the activation apparatus is switched to the deactivation position.

6. The clutch pedal assembly of claim 5 wherein the latch assembly includes a ratchet assembly, with the ratchet assembly including a ratchet having a clutch pedal engagement finger and a pawl coupled to the cable, the pawl movable by the cable into and out of engagement with the ratchet; and the clutch pedal includes a striker extending therefrom which is securable to the engagement finger of the ratchet.

7. The clutch pedal assembly of claim 5 wherein the latch assembly includes a housing mounted to the vehicle and a latch finger telescopically mounted in the housing and coupled to the cable.

* * * * *